United States Patent [19]

Chen

[11] Patent Number: 4,993,407

[45] Date of Patent: Feb. 19, 1991

[54] EXERCISER FOR DISEASED AND/OR AGED PEOPLE'S ARMS AND LEGS

[76] Inventor: Ko Chuan Chen, No. 125, Kuei-Lin Road, Taipei, 108, Taiwan

[21] Appl. No.: 309,135

[22] Filed: Feb. 13, 1989

[51] Int. Cl.[5] ..... A61H 1/02; A63B 21/00

[52] U.S. Cl. ..... 128/25 R; 272/73

[58] Field of Search ..... 272/73, 900, 143, 133; 128/25 R

[56] References Cited

U.S. PATENT DOCUMENTS

| | | | |
|---|---|---|---|
| 2,202,187 | 5/1940 | Chulette | 128/25 R |
| 2,261,355 | 11/1941 | Flynn | 128/25 R |
| 2,855,200 | 10/1958 | Blickman | 272/73 |
| 3,911,908 | 10/1975 | Duke | 128/25 R |
| 3,968,963 | 7/1976 | Sileo | 272/73 X |
| 4,544,155 | 10/1985 | Wallenbrock et al. | 272/143 X |
| 4,717,146 | 1/1988 | Nohara | 128/25 R |
| 4,739,984 | 4/1988 | Dranselka | 272/900 X |
| 4,776,583 | 10/1988 | Jennings | 272/73 |

FOREIGN PATENT DOCUMENTS 812332 2/1937 France .

*Primary Examiner*—Stephen R. Crow

*Attorney, Agent, or Firm*—Fleit, Jacobson, Cohn, Price, Holman & Stern

[57] ABSTRACT

A device designed for regaining the health of survivors from apoplexy, heart attack, poliomyelitis, accident and aged people by doing exercises. An adjustable-speed motor drives a pair of pedals so that the user's arms or legs can be hauled or dragged gently and regularly to move roundly with the user's arms or legs directly connected with the pedals and in turn with the motor or to move to and fro, up and down by a pair of wires which through a frame changes their direction, as controlled by the pedals.

3 Claims, 5 Drawing Sheets

FIG. 10
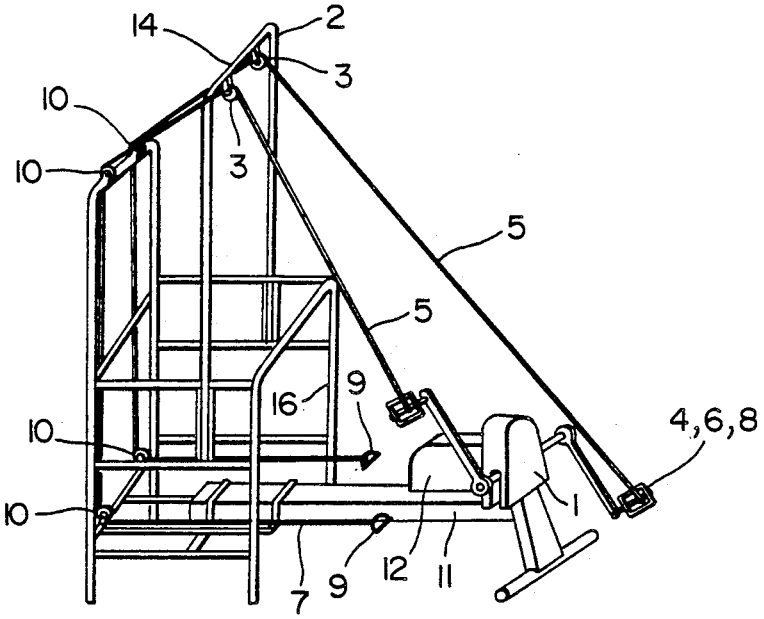
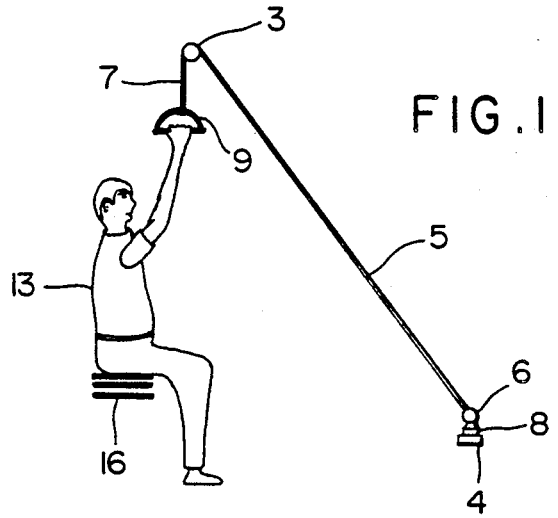
FIG. 11
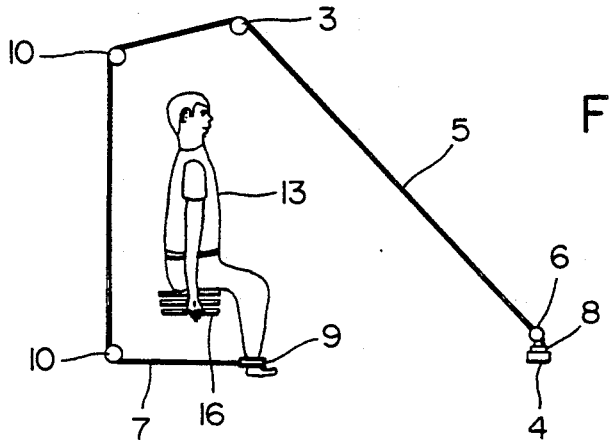
FIG. 12

EXERCISER FOR DISEASED AND/OR AGED PEOPLE'S ARMS AND LEGS

BACKGROUND OF INVENTION

A number of devices or apparatuses have been developed and used to help diseased people who have survived an attack from apoplexy, heart attack, polioyelitis, accident and the aged people to recover from their diseases and to resume their health. Most of the conventional devices or apparatuses cannot be used by the survivors or the aged people themselves without the assistance given by other health people. However, the present invention is an automatic device driven by home electricity, and can be used by diseased or aged people themselves without other's help.

SUMMARY

The present invention is a device which mainly consists of three parts: (1) An adjustable-speed motor with a pair of pedals and with or without a cam, (2) a chair and (3) a frame with wires for hauling operation. The motor drives the pair of pedals to turn directly or via the cam at a desirable speed on each of which a wire is fastened. The wires are arranged through the frame and change their directions to meet the need of the user. The other end of each of the wires is fastened, by use of a velcro band, to each of the user's hands or legs. Alternatively, when the user's hands can hold the rings at the ends of the wires, then the user's arms can be hauled in vertical, horizontal or circular motions without using the velcro band.

The object of the present invention is to provide an apparatus to be used by diseased or aged people to have their arms or legs in motions to and fro, up and down or round gently and regularly without others help. The other object of the present invention is to provide a rehabilitation machine to be used by diseased or aged people not only in the hospital but also in the user's house. The further object of the present invention is to provide a machine to be used by healthy people to do exercises for their health.

BRIEF DESCRIPTION OF THE DRAWINGS

FIG. 10. Showing the exercise of the user's legs in horizontal motion when the frame fastened on the chair and the motor plank is put horizontally on the ground.

FIG. 11. A sketch showing the relative positions of the parts 3 through 9.

FIG. 12. A sketch showing the relative positions of the parts 3 through 10.

The names with the designated numbers of the parts whown in the previous figures are listed as follows:

1. Eccentric wheel,
2. "Π" shaped frame,
3. Universal pulleys,
4. Pedals,
5. Wires,
6. Fixed hooks,
7. Other ends of wires,
8. Fastened hooks,
9. Velcro band,
10. Pulley sets,
11. Motor plank,
12. Motor,
13. User,
14. Middle bar,
15. Wall,
16. Chair,
17. Motor wire,
18. Motor wire plug,
19. Control box,
20. Socket,
21. Control box wire,
22. Box wire plug,
23. Motor axle,
24. Pedal bars.

DESCRIPTION OF THE PREFERRED EMBODIMENT

The present invention is embodied in various forms as shown in the FIGS. 2 through 10 in which a motor 12 may be referred as the focus part of the present invention. The motor 12 is a common type but its speed can be adjusted as desired and is fixed on the motor plank 11.

Figure 1:
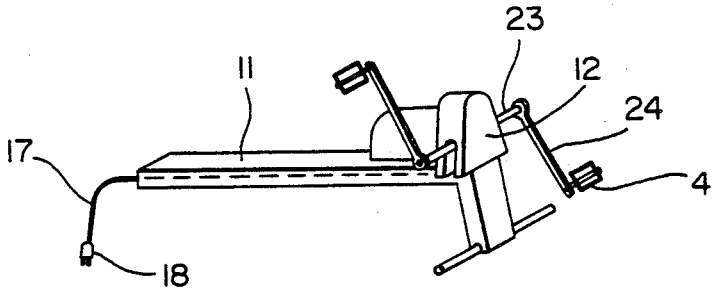
FIG. 1. Showing the motor and motor plank separately, without the wires and "Π"shaped frame.
Figure 2:
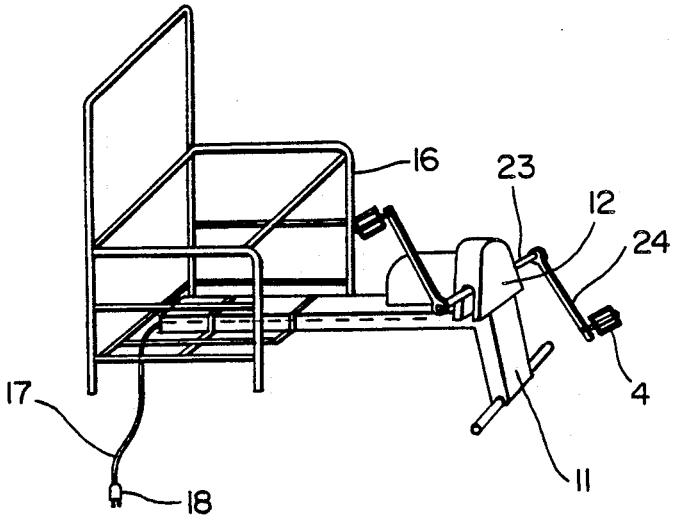
FIG. 2. Showing the exercise of the user's legs in a round motion with the pedals directly.
Figure 3:
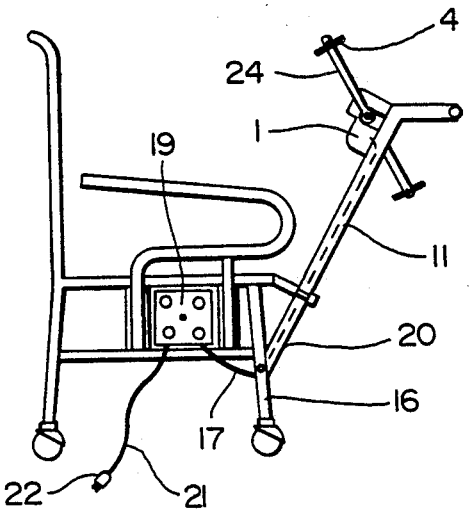
FIG. 3. Showing the exercise of the user's arms in a round motion with the pedals directly.

On each end of the motor axle 23 a pedal bar 24 is fixed. At the other ends of the pedal bars 24 a pair of pedals 4 is mounted (see FIG. 1). When the motor plank 11 with the motor 12 is set horizontally under the specially designed chair 16 (see FIG. 2) then the user can do exercise with his feet fastened by a pair of velcro bands 9 on the pedal 4. When the motor plank 11 with the motor 12 is set inclined in front of the chair 16 (see FIG. 3) then the user can do exercise with his hands holding on or being fastened by a pair of velcro bands 9 on the pedal 4. This exercise may cause the user's arms or legs to move in a circular motion.

The motor plank 11 is really a hollowed bar with a rectagular cross section. So that the motor wire (an electric wire coming from the motor 12) 17 can be set inside the motor plank 11 (see FIGS. 1–3). At the other end of the motor wire 17, a motor wire plug 18 is prepared which can plug into the socket 20 on the control box 19. The control box wire 21 comes from the control box 19 and has a box wire plug 22 at its other end which can plug into any socket (shown in the figures) in the system of house power supply. The control box 19 functions as a switchboard which can alter the revolving speed of the motor 12 as desired.

The motor plank 11 with the motor 12 can be mounted on a specially made chair 16 or fixed on the wall 15. A "Π" shaped frame 2 is applied and also can be mounted on the chair 16 or fixed on the wall 15. On the middle bar 14 of the "Π" shaped frame 2 two universal pulleys 3 are prepared. One or more pulley sets 10 may be needed and mounted on the upper and lower back bars of the chair 16. An eccentric wheel 1 may be used or not used. When it is used it is mounted near the motor 12 and connected with the motor 12. Again a pair of pedals 4 are coupled near the eccentric wheel 1 and connected with the eccentric wheel 1. Two fixed hooks 6 are used and each of them is fixed to each of the pedals 4.

A pair of wires 5 is another essential part of the present invention. The two wires 5 are arranged through the universal pulleys 3, one for each, and the pulley sets 10 when the two wire 5 are extended around the chair 16. One end of each wires 5 is fastened with a velcro band 9 (a trade name for a nylon fabric with a tiny hook on each fiber that addheres easily to other cloth surfaces) in which each of the arms of the user 13 is held. The other ends of wires 7 are connected to the pedals 4, one for each, by a pair of fastened hooks 8 on the other ends wires 7 to the fixed hooks 6 on the pedals 4. The velcro bands 9 are not needed and a pair of common rings are used instead when the user 13 can firmly hold the common rings.

The general and essential arrangement and structures are described as in the previous paragraphs and can be referenced in FIGS. 1 through 12. However, there is at least one or more special functions in each drawing.

Figure 4:
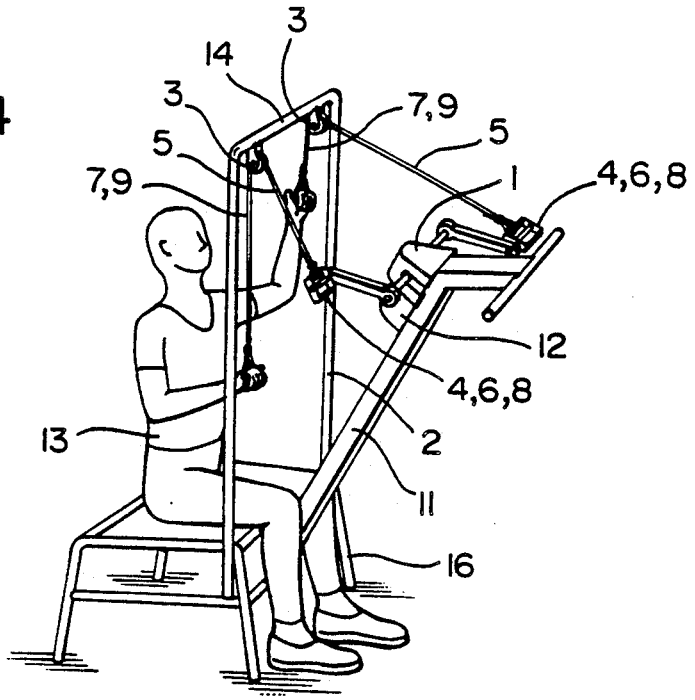
FIG. 4. Showing the exercise of the user's arms in linear motion when the frame fastened on the chair and the motor plank raised to an incline.

In FIG. 4, the user 13 is doing an exercise with his arms in a vertical or inclined motion when the "Π" shaped frame 2 is fixed onto the chair 16 and the motor plank 11 is mounted inclined.

Figure 5:
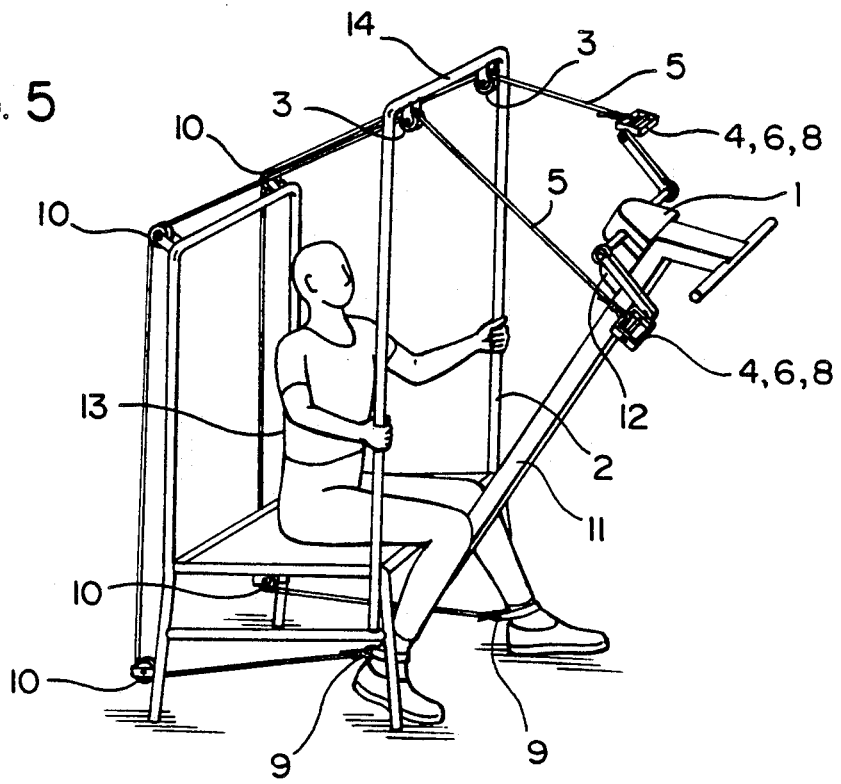
FIG. 5. Showing the exercise of the user's legs in horizontal motion when the frame fastened on the chair and the motor plank is raised to an incline.

In FIG. 5, the user 13 is doing an exercise with his legs in a horizontal motion, to and fro, when the extended wires 5 and two more pairs of pulley sets 10 are applied and the motor plank 11 is also placed inclined.

Figure 6:
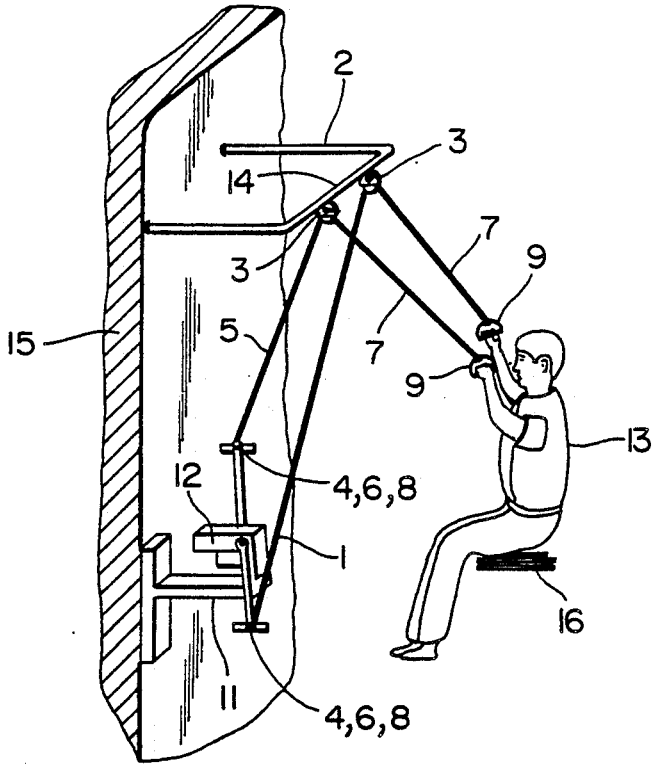
FIG. 6. Showing the exercise of the user's arms in linear motion when the frame and the motor plank are fastened on the wall.

In FIG. 6, the user 13 is doing an exercise with his arms in a vertical or inclined motion when the "Π" shaped frame 2 and the motor plank 11 are fixed onto the wall 15.

Figure 7:
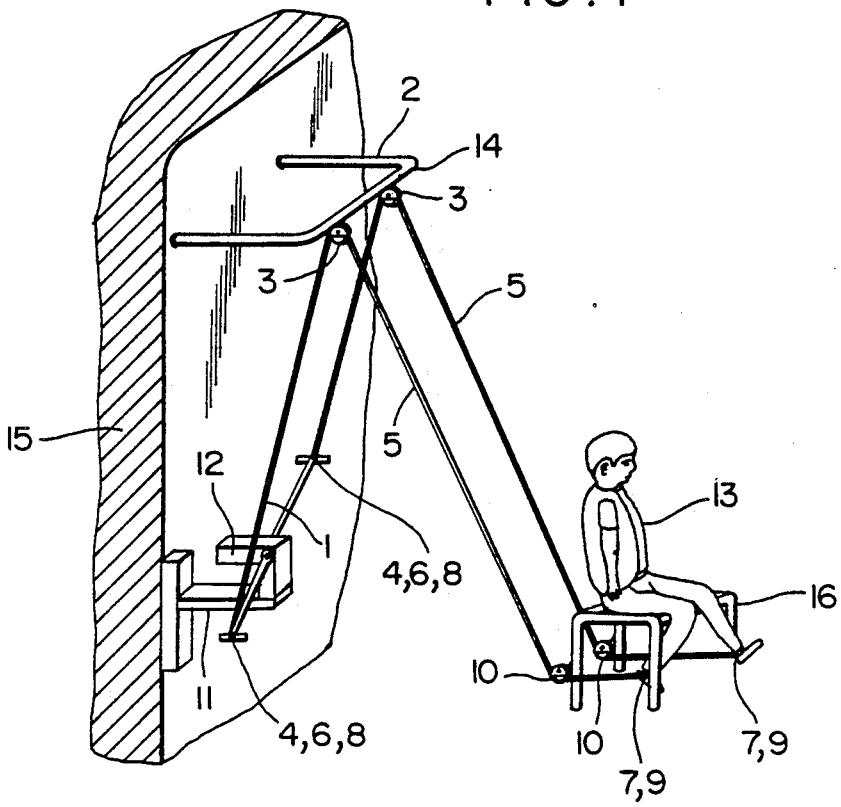
FIG. 7. Showing the exercise of the user's legs in horizontal motion when the frame and motor plank are fastened on the wall.

In FIG. 7, the user 13 is doing an exercise with his legs in a horizontal motion, to and fro when one more pair of pulley sets 10 is applied and the "Π" shaped frame 2 and the motor plank 11 are fixed onto the wall 15.

Figure 8:
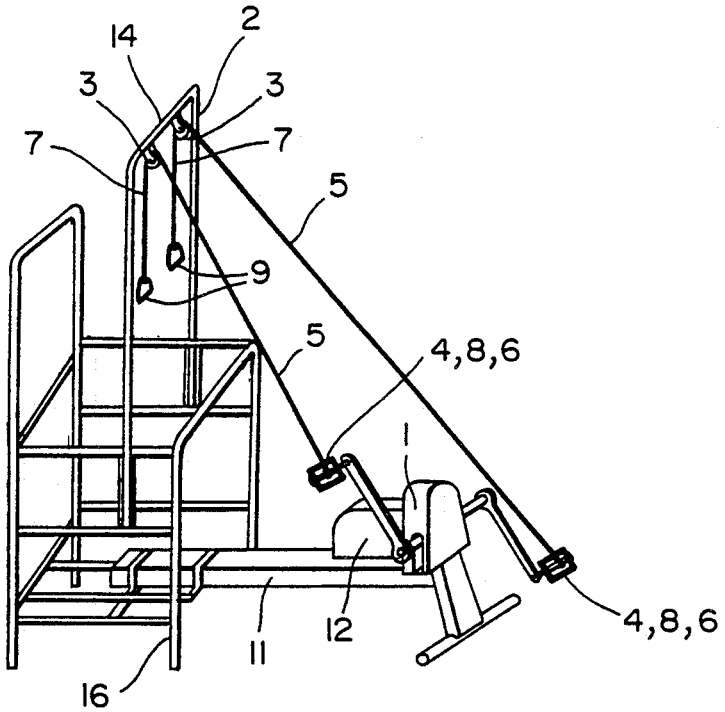
FIG. 8. Showing the exercise of the user's arms in vertical motion when the frame fastened on the chair and the motor plank is put horizontally on the ground.

FIG. 8, the user 13 (not really shown in the figure) is doing an exercise with his arms in a vertical motion, up and down, when the "Π" shaped frame 2 mounted on the chair 16 and the motor plank 11 is put on the ground and in front the chair 16.

Figure 9:
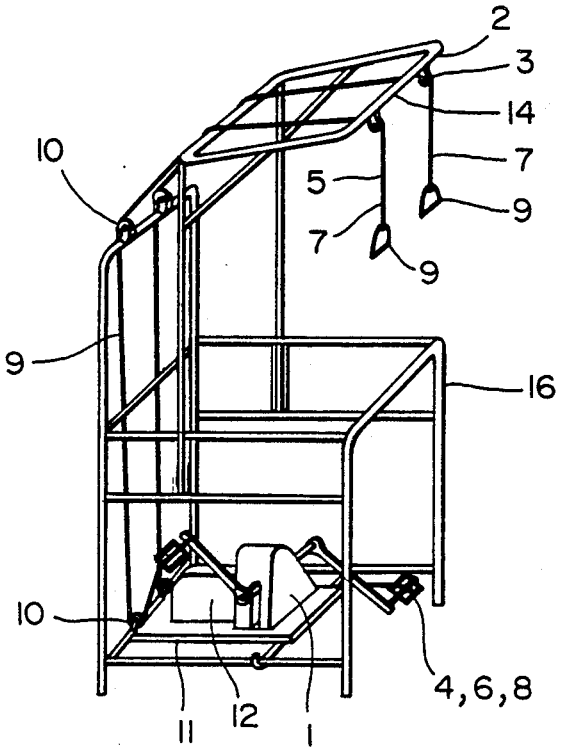
FIG. 9. Showing the exercise of the user's arms in vertical motion when the frame fastened on the chair and the motor plank put under and within the chair.

In FIG. 9, the user 13 (not really shown in the figure) is doing an exercise with his arm in a vertical motion, up and down, when the "Π" shaped frame 2 mounted on the chair 16, the extended wires 5 and two more pairs of pulley sets 10 are applied and the motor plank 11 with the motor 12 are placed under the chair 16.

In FIG. 10, the user 13 (not really shown in the figure) is doing an exercise with his legs in a horizontal motion, to and fro, when the "Π" shaped frame 2 is mounted on the chair 16, the extended wires 5 and two more pairs of pulley sets 10 are applied and the motor plank 11 with the motor 12 are placed on the ground in front of the chair 16.

I claim:

1. A device for helping diseased or aged people do exercises with their legs and arms to improve their health, said device comprising:

a chair having a seat for supporting an exerciser, a frame mounted on said chair, pulleys mounted on said frame directly above the seat of said chair, a motor plank mounted at one end to said chair, a variable speed motor mounted on said motor plank at an opposite end of said motor plank from said one end mounted to said chair, control means mounted on said chair and accessible to a person sitting on said chair for controlling a speed of said variable speed motor and for providing power to said variable speed motor, power means extending through said motor plank and electrically connected to said motor and said control means, a motor shaft of said motor, pedal bars mounted on said motor shaft, a pedal mounted on each of said pedal bars, two wires, each wire connected at one end to a respective pedal and being threaded through said pulleys, means for connecting the arms or legs of the exerciser to the opposite ends of said wires for movement of the arms or legs of the exerciser when the exerciser is sitting on the seat of said chair during actuation of said motor, said motor mounted on said motor plank being located with respect to said chair so that an exerciser is able to do exercises with his arms or legs, respectively, in a circular motion with his hands or legs connecting directly to said pedals when the exerciser sits on the seat of said chair, said wires being arranged through the pulleys fixed on said frame to change the directions of said wires, said one end of each of said wires being fastened to a respective pedal and the other end of each of said wires being held by or fastened to the user's arms when the exerciser sits on the seat of said chair so that when said motor turns at a desired speed as set by said control means, said pedals, wires and the user's arms also move vertically at the same speed.

2. A device according to claim 1, wherein said motor plank is mounted at an incline so as to support said motor in the air.

3. A device according to claim 1, wherein motor plank is mounted horizontally so as to space said motor from said chair.

* * * * *